US007753114B1

(12) United States Patent
Penisson

(10) Patent No.: US 7,753,114 B1
(45) Date of Patent: Jul. 13, 2010

(54) MAGNETIC WELLBORE CLEANING TOOL

(76) Inventor: Dennis J. Penisson, 2265 Highway 182, Raceland, LA (US) 70394

( * ) Notice: Subject to any disclaimer, the term of this patent is extended or adjusted under 35 U.S.C. 154(b) by 0 days.

(21) Appl. No.: 12/113,939

(22) Filed: May 1, 2008

(51) Int. Cl.
*E21B 31/06* (2006.01)

(52) U.S. Cl. ..... 166/99; 166/311; 166/66.5

(58) Field of Classification Search ..... 166/66.5, 166/99, 311; 175/308, 320, 328; 209/215
See application file for complete search history.

(56) References Cited

U.S. PATENT DOCUMENTS

| | | | | |
|---|---|---|---|---|
| 2,965,406 | A | 12/1960 | Le Bus, Sr. | |
| 3,089,724 | A | 5/1963 | Crooks | |
| 3,637,033 | A | 1/1972 | Mayall | |
| 5,078,870 | A | 1/1992 | Carpenter | |
| 5,461,746 | A | 10/1995 | Banik et al. | |
| 5,699,577 | A | 12/1997 | Rankin | |
| 5,965,018 | A | 10/1999 | Caiozza | |
| 6,216,787 | B1 | 4/2001 | Ruttley | |
| 6,308,781 | B2 | 10/2001 | Ruttley | |
| 6,354,386 | B1 | 3/2002 | Ruttley | |
| 6,357,539 | B1 | 3/2002 | Ruttley | |
| 6,439,303 | B1 | 8/2002 | Sorhus et al. | |
| 6,491,117 | B2 | 12/2002 | Ruttley | |
| 6,629,562 | B1 * | 10/2003 | Fidan | 166/99 |
| 6,655,462 | B1 | 12/2003 | Carmichael et al. | |
| 7,137,449 | B2 | 11/2006 | Silguero | |
| 7,219,724 | B2 | 5/2007 | Theriot, Sr. | |
| 7,350,409 | B2 * | 4/2008 | Klatt | 73/152.18 |
| 7,513,299 | B2 * | 4/2009 | Ruttley | 166/66.5 |
| 2006/0042790 | A1 * | 3/2006 | Ruttley | 166/99 |
| 2007/0068862 | A1 | 3/2007 | Sisemore | |

FOREIGN PATENT DOCUMENTS

| | | |
|---|---|---|
| DE | 3543295 | 6/1987 |

OTHER PUBLICATIONS

Well Flow International Flyer.
MiSWACO Flyer—"The Pup Tool".

* cited by examiner

*Primary Examiner*—David J. Bagnell
*Assistant Examiner*—Blake Michener
(74) *Attorney, Agent, or Firm*—Carver, Darden, Koretzky, Tessier, Finn, Blossman & Areaux, LLC; Raymond G. Areaux; Lisa Velez

(57) ABSTRACT

A magnetic wellbore cleaning tool having a plurality of magnetic ridges spaced longitudinally between top and bottom centralizers. In operation, the magnetic ridges modify the velocity of passing fluid circulating in the wellbore such that the fluid remains in close proximity to the tool's magnetic field thereby allowing for collection of ferromagnetic debris suspended in cleaning fluid circulating in a wellbore.

19 Claims, 9 Drawing Sheets

Sect. A-A

Sect. B-B

Sect. C-C

Sect. Z-Z

MAGNETIC WELLBORE CLEANING TOOL

BACKGROUND OF THE INVENTION

I. Field

The present invention relates to wells for producing gas and oil and, more particularly, to wellbore cleaning tools, and more particularly, to magnetic wellbore cleaning tools which collect ferromagnetic materials suspended in wellbore fluid.

II. Background

Various drilling and cleaning operations in the oil and gas industry create debris that becomes trapped in a wellbore, including ferromagnetic debris. Generally, fluids are circulated in such a wellbore to washout debris before completion of the well. Several tools have been developed for the removal of ferromagnetic debris from a wellbore. There is a continuing need for a more effective magnetic wellbore cleaning tool.

BRIEF SUMMARY OF THE INVENTION

Other types of magnetic cleaning tools have a limited amount of collection space. Still others utilize only one pole of the magnets included in the tool, thereby potentially wasting a portion of the magnets' attractive force. Yet others involve slots or recesses in the tool body itself, thereby, I speculate, exposing the tool to stress points that can shorten the life of the tool and potentially lead to a break occurring during cleaning operations.

Thus, it is an object of the present invention to create a simple, strong magnetic cleaning tool with maximized collection area. It is a further object of the present invention to create a more effective ferromagnetic debris collection tool by repeatedly changing the velocity of passing circulating fluid so that the ferromagnetic particles suspended in said fluid are, I speculate, caught in turbulent eddies which I further speculate keep said particles within the tool's magnetic field for a longer period of time and consequently, I further speculate, facilitating more effective collection by the present invention via magnetic attractive force.

In a preferred embodiment, the magnetic wellbore cleaning tool designed to remove ferromagnetic debris from a wellbore includes a tool body adapted to be attached to a work string and lowered into a wellbore case; an upper and a lower centralizer adapted to maintain a set distance between the tool body and the wellbore casing; a plurality of magnetic ridges further including one or more magnets arranged circumferentially around the tool body; and a plurality of circumferential collection areas located between adjacent magnetic ridges wherein the diameter of the tool body is smaller in the recessed collection areas than the diameter of the tool body at the magnetic ridges.

The magnetic ridges are evenly spaced along the central portion of the tool body between the top and bottom centralizers. The magnetic ridges may be formed directly from the tool body, or they may be formed by adjacent flanged ends of sleeves secured around the circumference of the central tool body.

Where the magnetic ridges are formed from the tool body itself, the magnetic ridges include two sides that are generally inclined with respect to the longitudinal access of the tool body as well as an apex that is generally parallel to the longitudinal axis of the tool body. One or more recesses are formed in each generally inclined side such that each generally inclined side holds one or more magnets which may include magnets in a stacked configuration. These magnets are held in place against the tool body by a removable retaining ring that is itself held in place by two bolts. In one embodiment the retaining ring also forms the apex of the magnetic ridge. A flexible seal, such as an o-ring, may also be included between the retaining ring and the magnets held thereby.

Where the magnetic ridges are formed from the flanged ends of adjacent sleeves, the respective flanged ends are aligned such that one or more recesses formed on the outer surface of each flanged end form one or more cavities between the secured flanged ends wherein each cavity holds at least one magnet.

In either disclosed embodiment of the present invention, adjacent magnetic ridges are separated by a circumferential secondary collection area wherein I speculate that ferromagnetic debris is collected due to the magnetic force created by the magnets held in the magnetic ridges. The tool diameter is smaller in the secondary collection areas than it is at the magnetic ridges; therefore, the annulus between the tool body and the wellbore casing is correspondingly larger. I speculate that this change in the size of the annulus will reduce the velocity of passing fluid, thereby creating eddy currents that will keep ferromagnetic debris that is suspended in the fluid within range of the magnetic attractive force of the present invention. I further speculate that this increased exposure to the magnetic attractive force of the present invention will enable the present invention to more effectively collect ferromagnetic debris suspended in passing circulating fluids.

In either disclosed embodiment, the magnets included in each magnetic ridge may or may not be covered or otherwise isolated from the harsh or caustic environment of the wellbore.

BRIEF DESCRIPTION OF THE DRAWINGS

For a further understanding of the nature and objects of the present invention, reference should be had to the following description taken in conjunction with the accompanying drawings in which like parts are given like reference numerals.

DETAILED DESCRIPTION OF THE INVENTION

Figure 1:
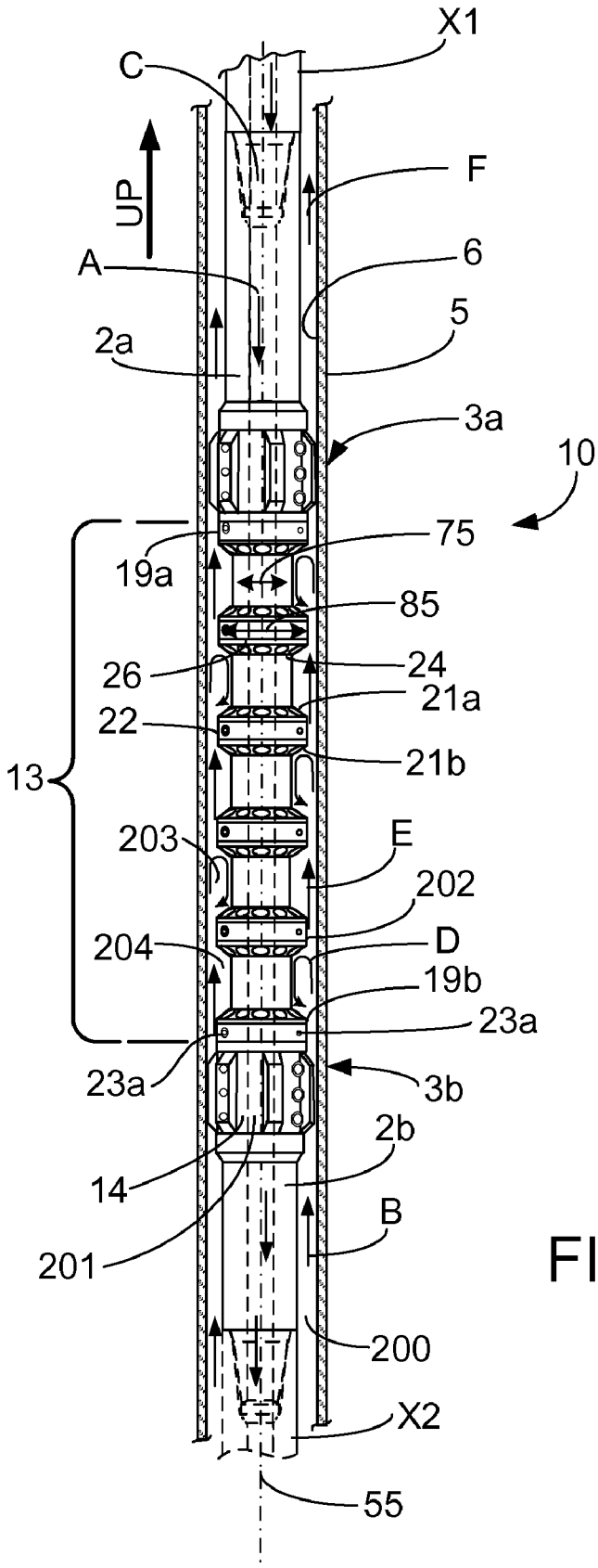
FIG. 1 illustrates a view of a first embodiment of the present invention installed in a wellbore.
Figure 2A:
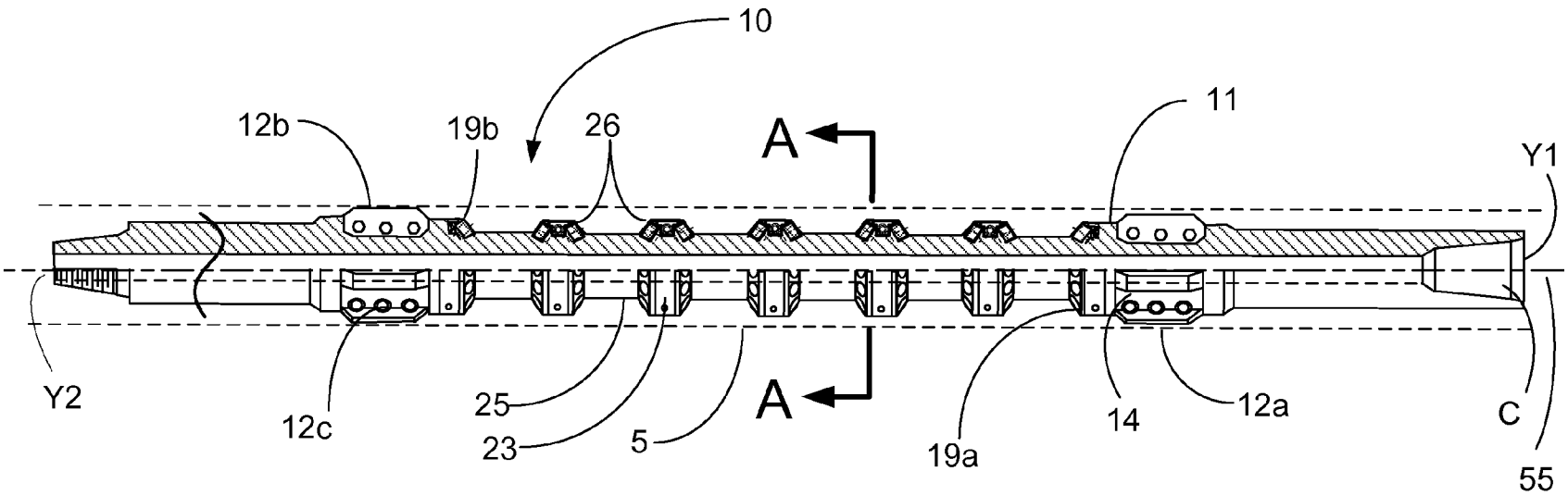
FIG. 2*a* illustrates a second view of a first embodiment of the present invention outside of a wellbore.
Figure 2B:
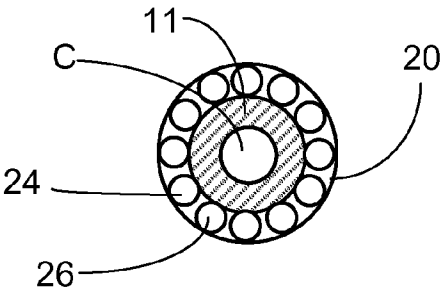
FIG. 2*b* illustrates a cross sectional view along plane A-A of the tool of FIG. 2*b*.

Referring now to the drawings, and particularly to FIGS. 1 and 2*a*, a first exemplary embodiment of the magnetic wellbore cleaning tool contemplated by the present invention is generally referenced as numeral 10. The magnetic wellbore cleaning tool 10 comprises, in general, a tool body 11 including top tool joints 2*a* for connection with an upper tubing string X1 and bottom tool joint 2*b* for connection with lower tubing string X2, top and bottom slotted centralizers 12*a* and 12*b* secured around the circumference of said tool joints 2*a* and 2*b* and configured to centralize the tool body 11 in the wellbore casing 5, a central tool body 13 with a plurality of circumferential magnetic ridges 20 distributed longitudinally (that is, axially) along the length thereof, and a plurality of recessed secondary collection areas 25 located between adjacent magnetic ridges 20.

The tool body 11 (including the plurality of magnetic ridges 20 and secondary collection areas 25) is a single-piece, unitary machined structure. As noted above, the tool body 11 has a top tool joint 2*a* and a bottom tool joint 2*b* for coupling the tool 10 to upper and lower tubing strings X1 and X2. The top and bottom tool joints 2*a* and 2*b* are shown as threaded. Thus, tool 10 may be directly connected to upper and lower tubing strings X1 and X2 which may include, in addition to other tubing, various devices such as junk collecting baskets, circulating tools, scrapers, brushes or other downhole tools. The tool body 11 is generally cylindrically shaped and includes an inlet port Y1 for receiving fluid from the upper tubing string X1, a hollow cylindrical center C for communicating fluid therethrough, and a exit port Y2 for passing fluid to the lower tubing string X2.

The tool body 11 is configured to receive the top and bottom centralizers 12*a* and 12*b* on the innermost portions 3*a* and 3*b* of tool joints 2*a* and 2*b*, respectively. As shown in FIGS. 1 and 2*a*, the centralizers 12*a* and 12*b* have an effective diameter greater than any other portion of the tool body 11 such that during cleaning operations in wellbore casing 5 the magnetic ridges 20 do not engage the wellbore sidewall 6. Centralizers 12*a* and 12*b* have a plurality of slots 14 which allow fluid to flow in the annulus 201 between the tool joints 2*a* and 2*b* and the wellbore sidewall 6. Bolts, rivets, or other conventional fasteners 12*c* secure the separate portions of the centralizers 12*a* and 12*b* around the tool body 11, thus allowing easy removal and replacement as the centralizers 12*a* and 12*b* wear with age and use or to place a different size centralizer 12*a* or 12*b* more appropriate for a given size wellbore casing 5.

Figure 3A:
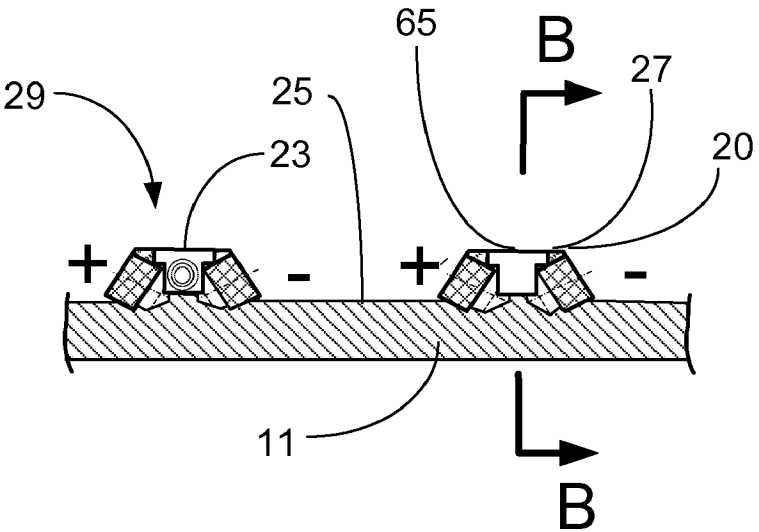
FIG. 3*a* illustrates a cross-sectional view of two magnetic ridges of a first embodiment of the present invention.
Figure 3B:
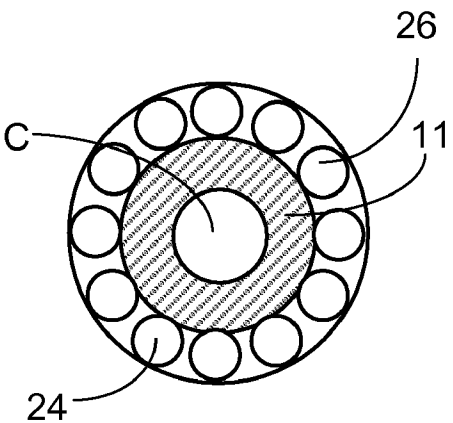
FIG. 3*b* illustrates a cross sectional view along plane B-B of the tool of FIG. 2*b*.
Figure 3C:
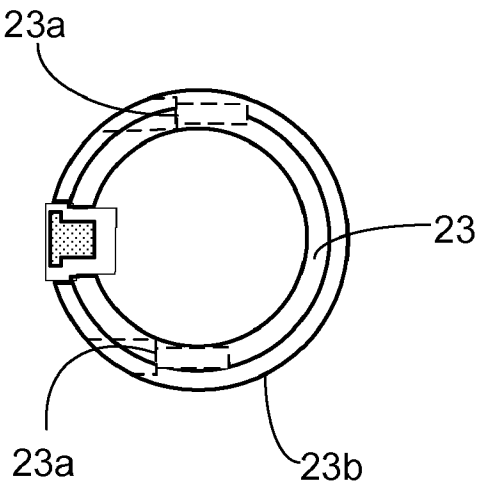
FIG. 3*c* illustrates a side view of a retaining ring.
Figure 4A:
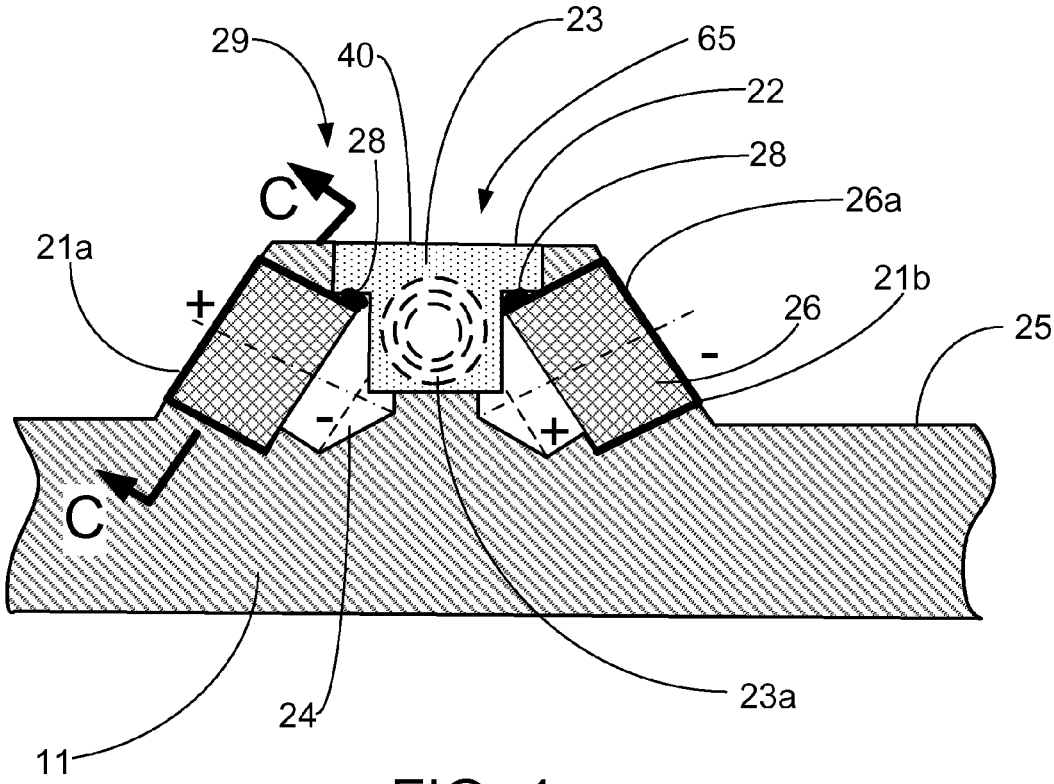
FIG. 4*a* illustrates a cross-sectional view of a signal magnetic ridge of a first embodiment of the present invention.
Figure 4B:
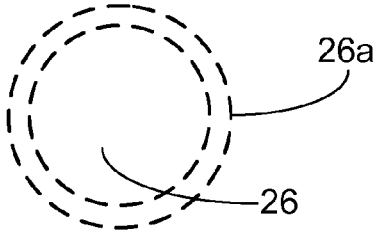
FIG. 4*b* illustrates a cross sectional view along plane C-C of the tool of a magnet and a magnet cover as shown in FIG. 4*a*.

The central tool body 13 is comprised of the portion of the tool body 11 between upper tool joint 2*a* and lower tool joint 2*b* and includes an alternating series of circumferential magnetic ridges 20 and secondary circumferential collection areas 25. As best shown in FIGS. 3*a* and 4*a*, each magnetic ridge 20 has inclining, sloping, curved or slanted circumferential surfaces 21*a* and 21*b* from the adjacent circumferential secondary collection area 25 to the circumferential apex 40 of said magnetic ridge 20. In a preferred embodiment, as best shown in FIGS. 3*a* and 4*a*, each magnetic ridge 20 has a trapezoidal longitudinal cross-section including: (1) two circumferential surfaces 21*a* and 21*b*, each of which is generally flat and inclined with respect to the longitudinal axis 55 of the tool body 11 so that the planes in which said surfaces reside intersect at a point external to the tool body 11; and (2), one flat surface 22 that is generally parallel to the longitudinal axis 55 of the primary tool body 11 and forming the apex 40.

At the top and bottom edge of the central tool body 13, where it meets tool joints 2*a* and 2*b*, half magnetic ridges 19*a* and 19*b* are formed that are comprised of only a single surface 21*a* and 21*b*, respectively and a flat surface 22.

More specifically, the magnetic ridges 20 are formed from the tool body 11 as a result of the plurality of secondary collection areas 25 being milled out of tool body 11 via machining. The depth to which the secondary collection areas 25 are machined is generally dictated by the tubing size of the tubing string X1 and X2. For example, a 3.5 inch tool would result in a tool 10 wherein the outer diameter 75 of the secondary collection areas 25 would be no less than 3.5 inches, and, in a preferred embodiment, would be 3.5 inches. By contrast, the outer diameter of the magnetic ridges 20 (measured from center of surface 22 and denoted as 85) is generally equivalent to the outer diameter of the tool joints 2*a* and 2*b*. (See FIGS. 1 and 2*a*). It is noted, however, that the removable retaining ring 23 and the magnets 26, described in more detail below, are not part of the tool body 11, but rather are added to the tool body 11 for operation thereof.

The magnetic ridges 20 are longitudinally (to wit, axially) spaced along the central tool body 13 between the centralizers 12*a* and 12*b*. The magnetic ridges 20 are generally spaced between 4.5 inches and 5 inches (center to center) apart, where larger spacing is typically used for larger diameter tools (for example, 5.5 inch tool might employ 4.5 inch spacing, while a 7 inch tool or 9.625 inch tool would employ a 5 inch spacing).

Each surface 21*a* and 21*b* includes a series of cavities or recesses 24 drilled or otherwise machined in said surfaces 21*a* and 21*b* at regular intervals around the circumference of the tool body 11, each recess 24 intended to house a single or stacked set of disk-shaped magnet(s) 26. The center portion 65 of each magnetic ridge 20 is comprised of a circumferential groove 27 machined into the tool body 11 between the surfaces 21*a* and 21*b* of each magnetic ridge 20 and a removable retainer ring 23 which fits into said groove 27 wherein said retainer ring 23, when tightened via fasteners 23*a*, secures the magnets 26 placed into the recesses 24. Some compressible material, such as an "O-ring" or other flexible seal 28, may be placed between the retainer ring 23 and the tool body 11 for securing the magnets 26 thereto.

The outer surface 23*b* of the retainer ring 23 comprises the surface 22 of the magnetic ridge 20. Note that while the surface 22 is shown as being generally parallel to the longitudinal axis 55 of the tool body 11 in the first exemplary embodiment, it need not be, but may be configured in other shapes or orientations. For example, surface 22 could be curved or it could be slanted relative to the longitudinal axis 55 of the tool body 11.

Each magnet 26 may also be covered by a magnet cover 26*a* designed to snugly fit around a magnet 26 and to protect said magnet 26 from the often harsh and corrosive exterior environment of the wellbore 5. In lieu of a magnet cover 26*a*, some other covering or coating may be applied to protect the magnets 26 from the hard environment of the wellbore and consequently inhibiting or preventing corrosion of the magnets 26. For example, grease or epoxy may be applied to the magnets 26.

In the first exemplary embodiment, a single disk-shaped Neodymium magnet 26 resides in each recess 24 and thus is secured within the magnetic ridge 20 by the retainer ring 23. Each magnet 26 generally has an axial height less than, or equal to, its diameter, but the size of the magnets 26 are not limited to these dimensions. Similarly, a stack of disk magnets can be used to form a single magnet 26. The plurality of magnet recesses 24 are arranged circumferentially around the tool body 11 in each magnetic ridge as shown in FIGS. 1, 2*a*, 2*b* and 3*b*. As such, the magnets 26 create a 360 degree magnetic field.

In the first exemplary embodiment, the magnets 26 are oriented such that any two opposing surfaces 21*a* and 21*b* (to with, a surface 21*a* and a surface 21*b* which are separated by a secondary collection area 25; or, in other words, a surface 21*a* on a first magnetic ridge 20 and a surface 21*b* on a second magnetic ridge 20 between which said first and second magnetic ridges 20 lies a secondary collection area 25) each show the opposite polarity to the exterior of the tool body 11. For example, if the magnets 26 along a surface 21*a* are oriented such that the positive magnetic pole faces somewhat outward from the surface of tool body 11 (due to the inclined surface 21*a*) and over a secondary collection area 25, then the magnets 26 along the opposing surface 21*b* are oriented such that the negative magnetic pole faces somewhat outward (due to the inclined surface 21*b*) from the surface of tool body 11 yet over the same secondary collection area 25.

Further, all of the magnets 26 located on a given surface 21*a* (or similarly located on a given surface 21*b*) of a magnetic ridge 20 are oriented such that the same magnetic polarity faces somewhat outward from tool body 11, and over a secondary collection area 25, for each magnet 26. (FIG. 4*a*). However, other arrangements and configurations of the magnetic polarity of the respective magnets 26 may be employed. For example, the magnets 26 in a given surface 21*a* or 21*b* can be oriented such that the magnets 26 have alternating (in a circumferential direction) polarities facing somewhat outward from the surface of tool body 11. Further still, the polarities of opposing surfaces 21*a* and 21*b* may be the same (i.e., perhaps more of a "bucking" arrangement"), as opposed to the configurations described above.

In addition to the primary collection area 29 formed by the surface of the magnetic ridges (in other words, the combination of surfaces 21*a*, 21*b* and 22), the area of the tool body 11 between each ridge 20 serves as a secondary collection area 25 for collecting iron debris or other magnetically attracted metals. It is speculated that a secondary magnetic force is projected into the secondary collection areas 25 such that a significant amount of material is collected not only on the primary collection area 29 but also in the secondary collection area 25.

A second exemplary embodiment of the present invention is shown in FIGS. 5*a*-9. This second embodiment is generally referred to as numeral 100. The magnetic wellbore cleaning tool 100 generally comprises a tool body 111 including top tool joint 102*a* for connection with an upper tubing string X10 and bottom tool joint 102*b* for connection with lower tubing string X20, top and bottom slotted centralizers 112*a* and 112*b* secured around the circumference of said tool joints 102*a* and 102*b* and configured to centralize the tool body 111 in the wellbore casing 105, and a central tool body portion 130 found between the top and bottom tool joints 102*a* and 102*b*.

The tool body 111 is a single-piece, unitary machined structure. The tool body 111 has a top tool joint 102*a* and a bottom tool joint 102*b* for coupling the tool 100 to upper and lower tubing strings X10 and X20, respectively. The top and bottom tool joints 102*a* and 102*b* are shown as threaded. Thus, tool 100 may be directly connected to upper and lower tubing strings X10 and X20 which may include, among other things, various devices such as junk collecting baskets, circulating tools, scrapers, brushes or other downhole tools. The tool body 111 is generally cylindrically shaped and includes an inlet port Y10 for receiving fluid from the upper tubing string X10, a hollow cylindrical center C1 for communicating fluid therethrough, and an exit port Y20 for passing fluid to the lower tubing string X20.

Figures 5A, 5B:
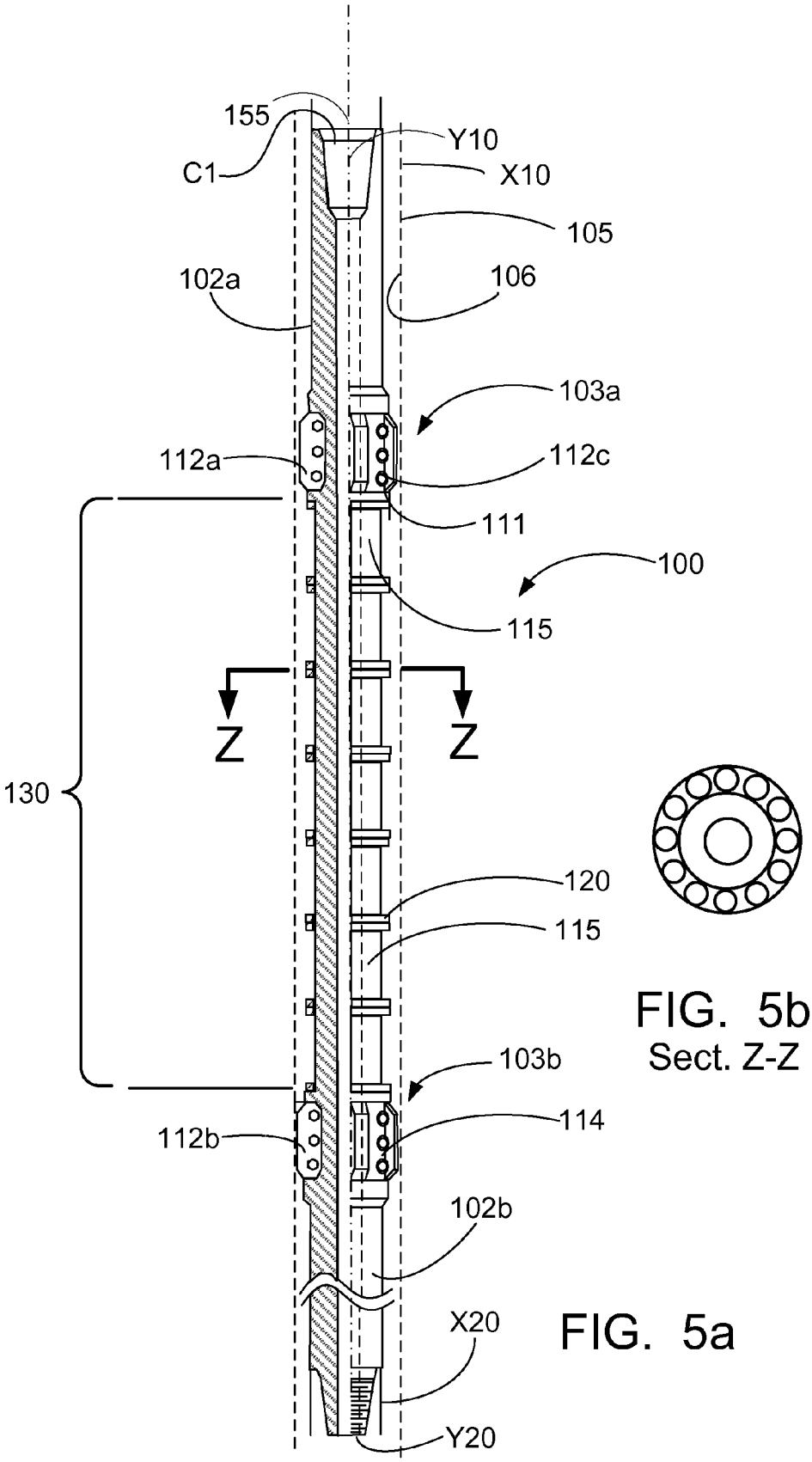
FIG. 5*a* illustrates a view of a second embodiment of the present invention installed in a wellbore.
FIG. 5*b* illustrates a cross sectional view along plane Z-Z of the tool of FIG. 5*a*.

The tool body 111 is configured to receive the top and bottom centralizers 112*a* and 112*b* on the innermost portions 103*a* and 103*b* of tool joints 102*a* and 102*b*, respectively. As shown in FIG. 5*a*, the centralizers 112*a* and 112*b* have an effective diameter greater than any other portion of the tool body 111 such that during cleaning operations in wellbore casing 105 the magnetic ridges 120 do not engage the wellbore sidewall 1066. Centralizers 112*a* and 112*b* have a plurality of slots 114 which allow fluid to flow in the annulus 201 between the tool joints 102*a* and 102*b* and the wellbore sidewall 106. Bolts, rivets, or other conventional fasteners 112*c* secure the separate portions of the centralizers 112*a* and 112*b* around the tool body 111, thus allowing easy removal and replacement as the centralizers 112*a* and 112*b* wear with age and use or to place a different size centralizer 112*a* or 112*b* more appropriate for a given size wellbore casing 105.

Figure 6:
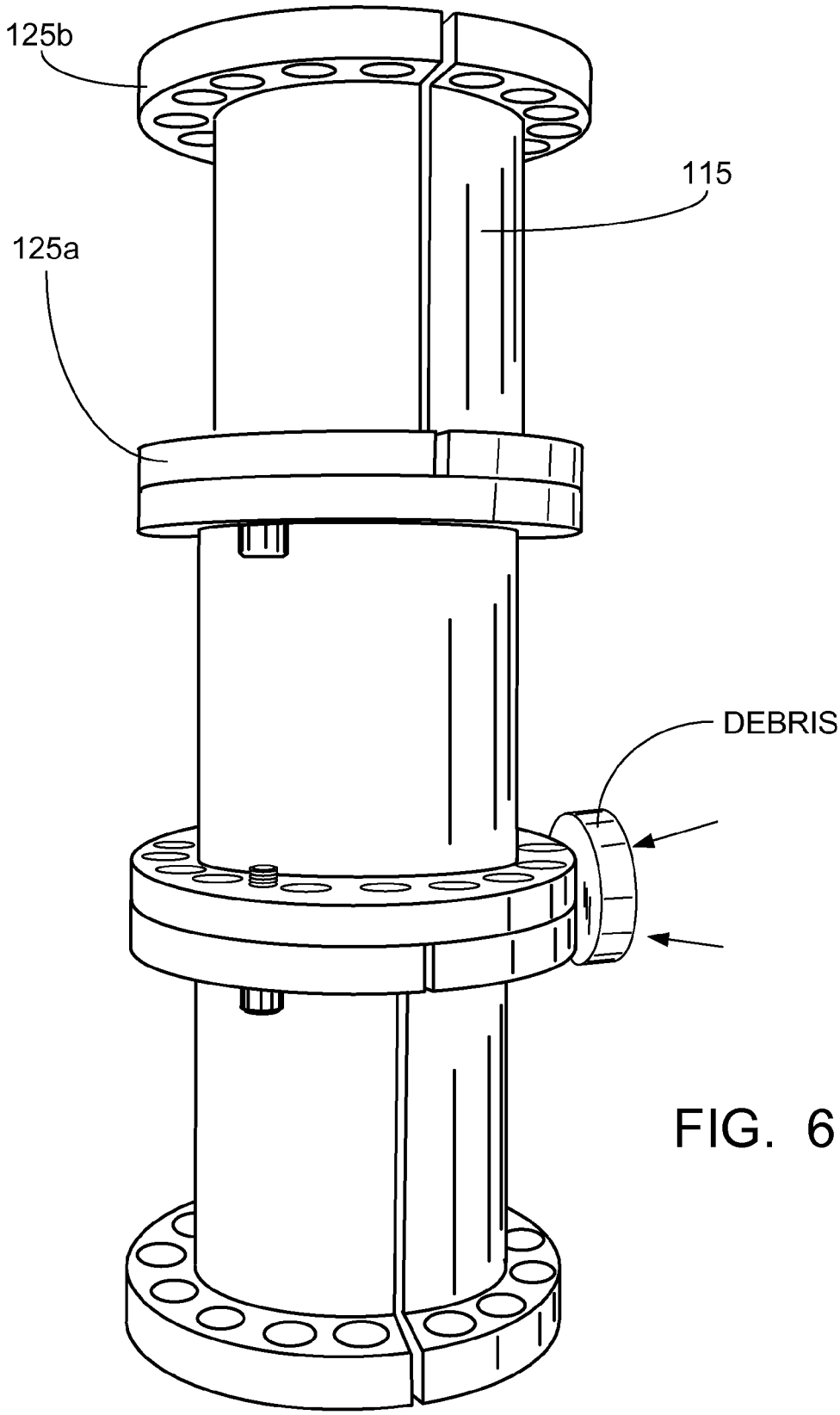
FIG. 6 illustrates a perspective view of several sleeves of a second embodiment of the present invention coupled together.
Figure 7:
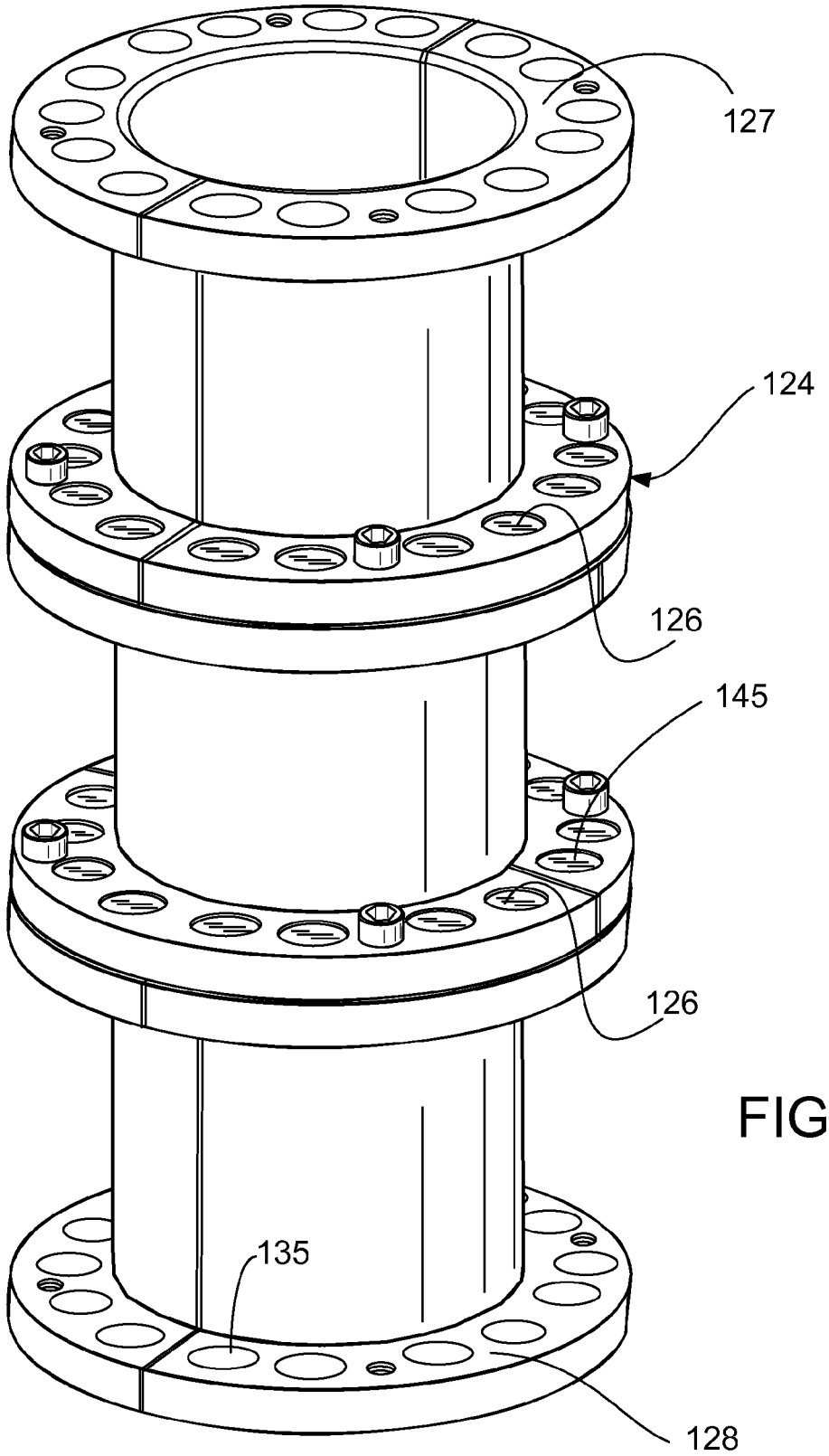
FIG. 7 illustrates a second perspective view of several sleeves of a second embodiment of the present invention coupled together.
Figure 8:
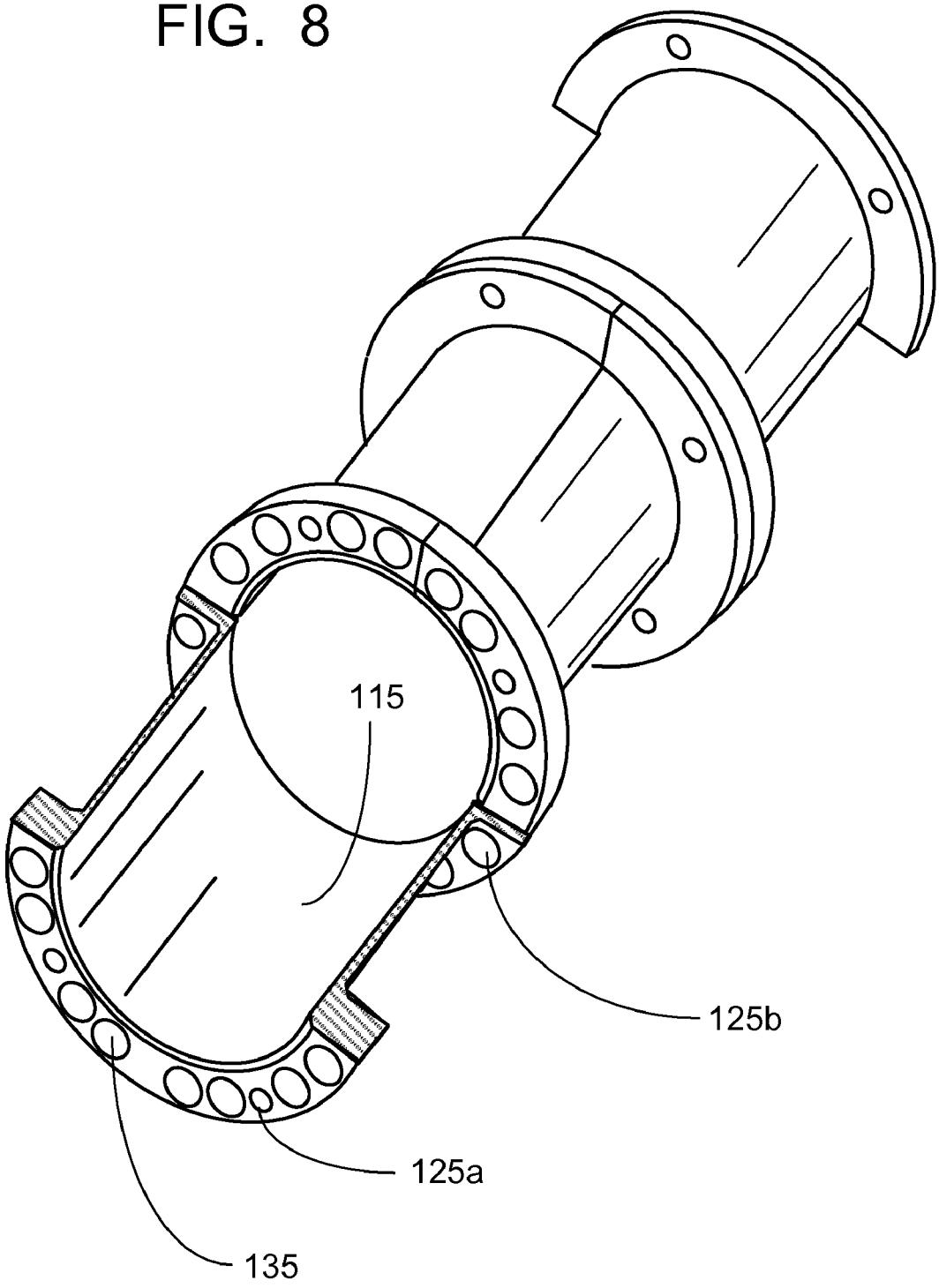
FIG. 8 illustrates a three-dimensional rendering of several sleeves of a second embodiment of the present invention coupled together.
Figure 9:
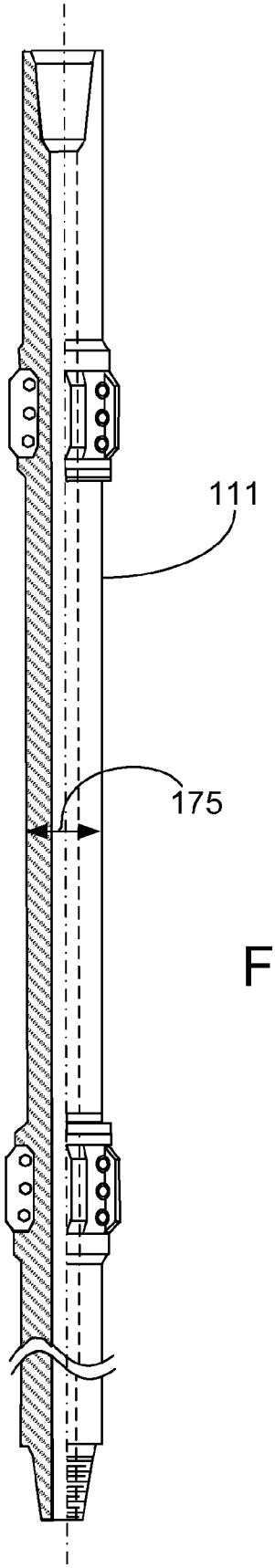
FIG. 9 illustrates a tool body of a second embodiment of the present invention without any sleeves attached thereto.

Central tool body portion 130 is machined with an outer diameter 175 (FIG. 9) along the entire length of central body portion 130. Tool 100 includes removable semi-circular flanged sleeves 115 that, when bolted or otherwise fastened together end-to-end as shown in FIGS. 5*a* and 6-8, completely encircle and cover the central tool body portion 130 (FIG. 5*a*). Each sleeve 115 has a flange 125*a* on one end and 125*b* on the other end. Each flange 125*a* and 125*b* has formed on an outboard side 127 a plurality of recesses 135 which, when the flanges 125*a* and 125*b* of two adjacent sleeves 115 are brought together as shown in FIGS. 6-8, form cavities 124 in which magnets 126 are intended to be housed, thereby creating magnetic ridges 120 at the intersection of adjacent sleeves 115. The sleeves 115 may be made of stainless steel, plastic, or some other non-magnetic material. The sleeves 115 may rotate independently of the tool body 111 or may be fixedly coupled thereto.

A plurality of sleeves 115 are arranged longitudinally along the axial length 155 of the central tool body portion 130 as shown in FIG. 5*a*. The magnetic ridges 120 may completely enclose the magnets 126, protecting them from the exterior environment of the wellbore 105, or they may have openings 145 formed on the inboard side 128 of each flange (see, e.g., FIGS. 6-8) allowing the surface of the magnets 126 to act as collection areas for ferromagnetic debris. The magnets 26 used in tool 100 are small, disk-shaped Neodymium magnets, sized to fit, either singly or in a stack, within the cavities 124 formed between the flanges 125*a* and 125*b*.

At the top and bottom edge of the central tool body 130, where it meets tool joints 102*a* and 102*b*, half magnetic ridges 119*a* and 119*b* are formed that are comprised of only a single flange 125*a* and 125*b*, respectively. The tool body 11 in the form of the tool joints 102*a* and 102*b* serve to hold the magnets 126 in the recesses 135 in each respective half magnetic ridge 119*a* and 119*b*.

Turning to back FIG. 1, circulating fluid is generally pumped down into the wellbore through the center of the tool body 11 (see Arrow A showing cleaning fluid being pumped down through central opening C). This fluid is eventually circulated back up the wellbore 5 in the annulus 200 between the tubing string X2 and the wellbore sidewall 6 as shown by Arrow B. The upward-moving circulating fluid passes through the slots 14 in the bottom centralizer 12*b* and enters the annuls 204 adjacent to the bottom-most section of central tool body 13 as shown by Arrow D. Due to the reduced outer diameter of the tool body 11 at the first secondary collection area 25 (found between the centralizer 12*b* and the magnetic ridge 20 closest to said centralizer 12*b*), as compared to the outer diameter of the tool body 11 at the tool joint 2*b*, the annulus 204 between the tool body 11 and the wellbore sidewall 6 is greater than the annulus 201 between the tool joint 2*b* and the wellbore sidewall 6, thereby, I speculate, reducing the velocity of the circulating fluid. I speculate that this change in velocity will create an eddy effect as shown by Arrow D. I further speculate that said eddy effect which will cause ferromagnetic debris suspended in the circulating fluid to remain in the vicinity of the magnetic attractive force of the magnetic ridges 20, and thereby make said debris more susceptible to collection via said magnetic force.

As the circulating fluid continues to move upward along the wellbore 5, as shown by Arrow E, it will necessarily pass over the primary collection area 29 and encounter each successive magnetic ridge 20 thereby providing additional opportunities to collect passing ferromagnetic debris as I speculate that a higher volume of passing fluid will be forced into contact with the magnetic field of the various magnetic ridges 20. As the fluid approaches and eventually reaches the apex 40 of each magnetic ridge 20, the annulus 202 between said magnetic ridge 20 and the wellbore sidewall 6 will be reduced due to the increasing diameter of the tool body 11 between the edge of the secondary collection area 25 and the apex 40 of said magnetic ridge 20. It is expected that this reduced annulus 202 will increase the velocity at which the circulating fluid moves past the tool 10, only to have said velocity reduced again as the outer diameter of the tool body 11 is again reduced creating annulus 203, thereby, I speculate, creating another eddy current and another opportunity for ferromagnetic debris to become entrapped in the magnetic field of the magnetic wellbore cleaning tool 10. This process is repeated until the circulating fluid reaches the top centralizer 12*b* and passes further up the wellbore as shown by Arrow F. It is speculated that this repeated change in the velocity of the passing circulating fluid will create turbulence such that suspended ferromagnetic particles will remain within the magnetic field of tool 10 for a longer period of time, thereby creating a more effective magnetic cleaning tool.

It is observed that the above described process applies equally to either embodiment disclosed herein.

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

PARTS LIST

2*a* Top Tool Joint
2*b* Bottom Tool Joint
3*a* Innermost Portion of Top Tool Joint 2*a*
3*b* Innermost Portion of Bottom Tool Joint 2*b*
5 Wellbore Casing
6 Sidewall of Wellbore Casing
10 First Embodiment of Magnetic Wellbore Cleaning Tool
11 Primary Tool Body
12*a* Top Slotted Centralizer
12*b* Bottom Slotted Centralizer
12*c* Fasteners
13 Central Tool Body Portion of First Embodiment
14 Slots in Centralizers
15*a* Top End of Tool Body
15*b* Bottom End of Tool Body
19*a* Half Magnetic Ridge
19*b* Half Magnetic Ridge
20 Circumferential Magnetic Ridges
21*a* Surface of Magnetic Ridge 20
21*b* Surface of Magnetic Ridge 20
22 Surface of Magnetic Ridge 20
23 Removable Retaining Ring
23 a Fasteners
23*b* Outer Surface of Retaining Ring 23
24 Recess
25 Circumferential Secondary Collection Areas
26 Magnet
26*a* Magnet Cover
27 Circumferential Groove in Magnetic Ridge 20
28 Flexible Seal
29 Primary Collection Area
40 Circumferential Apex
55 Longitudinal Axis of Tool Body
65 Center Portion of Magnetic Ridge
75 Outer Diameter of Secondary Collection Area
85 Outer Diameter of Magnetic Ridge
100 Second Embodiment of Magnetic Wellbore Cleaning Tool
102*a* Top Tool Joint
102*b* Bottom Tool Joint
103*a* Innermost Portion of Top Tool Joint
103*b* Innermost Portion of Bottom Tool Joint
105 Wellbore Casing
106 Sidewall of Wellbore Casing
111 Primary Tool Body
112*a* Top Centralizer
112*b* Bottom Centralizer
112*c* Fastener
114 Slot
115 Semi-Circular Flanged Sleeve
119*a* Half Magnetic Ridge
119*b* Half Magnetic Ridge
120 Magnetic Ridge
124 Cavity Formed Between Flanges by Adjacent Recesses 135
125*a* Flange
125*b* Flange
126 Magnet
127 Outboard Side of Flange
128 Inboard Side of Flange
130 Central Tool Body Portion of Second Embodiment
135 Recess in Flange
145 Opening
150*a* Top End of Tool body
150*b* Bottom End of Tool Body
200 Annulus Between Tubing String and Wellbore Sidewall
201 Annulus Between Tool Joint and Wellbore Sidewall
202 Annulus Between Secondary Collection Area and Wellbore Sidewall
203 Annulus Between Magnetic Ridge and Wellbore Sidewall
204 Annulus Between Secondary Collection Area and Wellbore Sidewall
C Central Opening
C1 Central Opening
A Fluid Being Pumped Down Through Work String
B Fluid Flowing Up Wellbore
D Eddy Current E Fluid Flowing Past Magnetic Ridge
F Fluid Passing Up Wellbore Beyond Magnetic Wellbore Cleaning Tool
X1 Upper Tubing String
X2 Lower Tubing String
Y1 Upper Inlet Port
Y2 Lower Exit Port
X10 Upper Tubing String
X20 Lower Tubing String
Y10 Upper Inlet Port
Y20 Lower Exit Port

What is claimed is:

1. A wellbore cleaning tool for removing ferromagnetic debris from a wellbore, comprising:
a tool body configured to attach to a work string and having a longitudinal axis;
a plurality of circumferential ridges axially spaced along said tool body, each ridge comprising:
an apex parallel to said longitudinal axis,
a first circumferential side surface angled with respect to and extending between said apex and the tool body, the first side surface having a first plurality of cavities formed therein, and
a second circumferential side surface opposing said first side and angled with respect to and extending between said apex and the tool body, the second circumferential side surface having a second plurality of cavities formed therein wherein each cavity of the first plurality of cavities and each cavity of the second plurality of cavities being configured to house therein a respective different one magnet of a plurality of magnets; and
a plurality of circumferential collection areas located between adjacent ridges, wherein an outer diameter of said plurality of circumferential collection areas is smaller than an outer diameter of the plurality of circumferential ridges.

2. The tool according to claim 1, wherein said each ridge has a trapezoidal longitudinal cross-section defined by the apex and the first and second circumferential side surfaces wherein the first and second circumferential side surfaces are flat and inclined with respect to the longitudinal axis of the tool body, and a plane of the first circumferential side surface and a plane of the second circumferential side surface intersect at a point external to the tool body.

3. The tool according to claim 2, wherein said each ridge further comprises a circumferential groove formed between the first and second circumferential side surfaces.

4. The tool according to claim 3, further comprising a plurality of removable retaining rings, each removable retaining ring configured to fit within a respective one circumferential groove and configured to secure said plurality of magnets housed within said first plurality of cavities and said second plurality of cavities.

5. The tool according to claim 4, further comprising at least one flexible seal placed between the plurality of magnets and the removable retainer ring associated with a respective one ridge.

6. The tool according to claim 5, wherein said at least one flexible seal is an O-ring.

7. The tool according to claim 1, further comprising a plurality of magnet covers, each respective one cover being configured to fit over the respective different one magnet of the plurality of magnets.

8. The tool according to claim 1, wherein said tool body, said plurality of circumferential ridges and said plurality of circumferential collection areas are integrated as a single-piece, unitary machined structure.

9. The tool according to claim 5, further comprising:
an upper tool joint near a first distal end of said tool body and having a first centralizer coupled thereto;
a lower tool joint near a second distal end of said tool body and having a second centralizer coupled thereto;
an upper circumferential half ridge (UCHR) in proximity to the upper tool joint, the UCHR comprising:
an UCHR apex parallel to said longitudinal axis, and
a UCHR circumferential side surface angled with respect to and extending between said UCHR apex and the tool body, the UCHR circumferential side surface having a plurality of UCHR cavities formed therein wherein each UCHR cavity of the plurality of UCHR cavities being configured to house therein a respective different one UCHR magnet of a plurality of UCHR magnets; and
a lower circumferential half ridge (LCHR) in proximity to the lower tool joint, the LCHR comprising:
an LCHR apex parallel to said longitudinal axis, and
a LCHR circumferential side surface angled with respect to and extending between said LCHR apex and the tool body, the LCHR circumferential side surface of having a plurality of LCHR cavities formed therein wherein each LCHR cavity of the plurality of LCHR cavities being configured to house therein a respective different one LCHR magnet of a plurality of LCHR magnets.

10. The tool according to claim 1, wherein:
those magnets housed in the first plurality of cavities of the first circumferential side surface of said each ridge are oriented to face a magnetic polarity outward from said tool body and over a circumferential collection area of the plurality of circumferential collection areas being immediately adjacent to the first circumferential side surface; and
those magnets housed in the second plurality of cavities of the second circumferential side surface of said each ridge are oriented to face a magnetic polarity outward from said tool body and over a circumferential collection area of the plurality of circumferential collection areas being immediately adjacent to the second circumferential side surface.

11. A wellbore cleaning tool for removing ferromagnetic debris from a wellbore, comprising:
a plurality of magnets;
a tool body configured to attach to a work string and having a longitudinal axis;
a plurality of circumferential ridges axially spaced along said tool body, each ridge comprising:
an apex parallel to said longitudinal axis,
a first circumferential side surface angled with respect to and extending between said apex and the tool body, the first side surface having a first plurality of cavities formed therein, and
a second circumferential side surface opposing said first side and angled with respect to and extending between said apex and the tool body, the second circumferential side surface having a second plurality of cavities formed therein wherein each cavity of the first plurality of cavities and each cavity of the second plurality of cavities being configured to house therein a respective different one magnet of the plurality of magnets; and
a plurality of circumferential collection areas located between adjacent ridges, wherein an outer diameter of said plurality of circumferential collection areas is smaller than an outer diameter of the plurality of circumferential ridges wherein said tool body, said plurality of circumferential ridges and said plurality of circumferential collection areas are integrated as a single-piece, unitary machined structure.

12. The tool according to claim 11, wherein said each ridge has a trapezoidal longitudinal cross-section defined by the apex and the first and second circumferential side surfaces wherein the first and second circumferential side surfaces are flat and inclined with respect to the longitudinal axis of the tool body, and a plane of the first circumferential side surface and a plane of the second circumferential side surface intersect at a point external to the tool body.

13. The tool according to claim 12, wherein said each ridge further comprises a circumferential groove formed between the first and second circumferential side surfaces.

14. The tool according to claim 13, further comprising a plurality of removable retaining rings, each removable retaining ring configured to fit within a respective one circumferential groove and configured to secure said plurality of magnets housed within said first plurality of cavities and said second plurality of cavities.

15. The tool according to claim 14, further comprising at least one flexible seal placed between the plurality of magnets and the removable retainer ring associated with a respective one ridge.

16. The tool according to claim 15, wherein said at least one flexible seal is an O-ring.

17. The tool according to claim 11, further comprising a plurality of magnet covers, each respective one cover being configured to fit over the respective different one magnet of the plurality of magnets.

18. The tool according to claim 11, further comprising an upper tool joint near a first distal end of said tool body and having a first centralizer coupled thereto;

a lower tool joint near a second distal end of said tool body and having a second centralizer coupled thereto;

an upper circumferential half ridge (UCHR) in proximity to the upper tool joint, the UCHR comprising:

an UCHR apex parallel to said longitudinal axis, and a UCHR circumferential side surface angled with respect to and extending between said UCHR apex and the tool body, the UCHR circumferential side surface having a plurality of UCHR cavities formed therein wherein each UCHR cavity of the plurality of UCHR cavities being configured to house therein a respective different one UCHR magnet of a plurality of UCHR magnets; and a lower circumferential half ridge (LCHR) in proximity to the lower tool joint, the LCHR comprising:

an LCHR apex parallel to said longitudinal axis, and a LCHR circumferential side surface angled with respect to and extending between said LCHR apex and the tool body, the LCHR circumferential side surface of having a plurality of LCHR cavities formed therein wherein each LCHR cavity of the plurality of LCHR cavities being configured to house therein a respective different one LCHR magnet of a plurality of LCHR magnets.

19. The tool according to claim 11, wherein:

those magnets housed in the first plurality of cavities of the first circumferential side surface of said each ridge are oriented to face a magnetic polarity outward from said tool body and over a circumferential collection area of the plurality of circumferential collection areas being immediately adjacent to the first circumferential side surface; and those magnets housed in the second plurality of cavities of the second circumferential side surface of said each ridge are oriented to face a magnetic polarity outward from said tool body and over a circumferential collection area of the plurality of circumferential collection areas being immediately adjacent to the second circumferential side surface.

* * * * *